United States Patent [19]

Lalanne et al.

[11] 4,194,454

[45] Mar. 25, 1980

[54] METHOD FOR INCINERATING SLUDGES

[75] Inventors: Jean Lalanne; Jean-Pierre Nivert, both of Artix; Daniel Tarascou, Pau, all of France

[73] Assignee: Societe Nationale Elf Aquitaine, Courbevoie, France

[21] Appl. No.: 946,092

[22] Filed: Sep. 26, 1978

[30] Foreign Application Priority Data

Sep. 29, 1977 [FR] France ..... 77 29264

[51] Int. Cl.[2] ..... F23G 5/12

[52] U.S. Cl. ..... 110/238; 110/346

[58] Field of Search ..... 110/235, 238, 346; 431/2, 5, 174

[56] References Cited

U.S. PATENT DOCUMENTS

| | | | |
|---|---|---|---|
| 2,808,011 | 10/1957 | Miller et al. | 110/238 |
| 3,362,360 | 1/1968 | Lowe | 110/238 |
| 3,718,102 | 2/1973 | Hemsath et al. | 110/238 |
| 4,094,625 | 6/1978 | Wang | 110/238 X |

FOREIGN PATENT DOCUMENTS

| | | | |
|---|---|---|---|
| 2250072 | 5/1975 | France | 110/238 |

*Primary Examiner*—Edward G. Favors

*Attorney, Agent, or Firm*—Brisebois & Kruger

[57] ABSTRACT

A method for incinerating sludges comprising the steps of delivering a very homogeneous mixture of at least one combustible gas with a large amount of excess air at a plurality of locations in the lower part of an incineration zone; initiating the combustion of said mixture; finely pulverizing the sludge in the combustion zone; evacuating the incineration products from the incineration zone by carrying them along with the gaseous combustion products and controlling precisely the temperature of the combustion products while they are being evacuated from the incineration zone.

10 Claims, 12 Drawing Figures

5
13
16'
4
17
1
2
27
18
19a
19
22a
22b
24
19b
26
20
22d
23
21
25
18a
24a
22c
23
12
6
16
3
6a
6b
6c
10'
3''
3'
10
7
11
8
9
14
14'
15
15
15'

METHOD FOR INCINERATING SLUDGES

The present invention concerns a method for incinerating sludges or slurries, especially industrial or city waste materials, which are partially combustible and which are in the form of sludges.

Various methods for incinerating sludges of industrial or city origin are known, these methods have been adapted to the various degrees of water content and the degree of compactness of these sludges.

Shovel transferable sludges which have a low water content and a comparatively high compactness are generally incinerated by fluidized bed techniques; however these known methods raise a great number of difficulties.

The sludges having a water content of about 80% are fluid enough to be displaced by pumping, which facilitates the feeding of the incinerating oven.

The feeding of such sludges into a fluidized bed oven raises a great number of problems, especially as regards the heat supply to the fluidized bed and the spraying of the sludge. In fact, sludges having a very high water content are not suitable for incineration by fluidized bed techniques.

Various methods of incinerating sludges have been proposed in the past, wherein the sludge is directly projected and, up to a certain point, pulverized in the flame of a burner utilising, as a combustible substance, liquid or gaseous hydrocarbons. Whichever combustible substance (or fuel) is used, it is very difficult to obtain a sufficiently uniform and stable temperature level within the range of favourable temperatures, for achieving a complete combustion of the combustible portion of the sludge.

The various known pulverization appliances are generally adapted to producing high flow velocities of the sludge through orifices having a very small cross-section. These appliances are often clogged, in their pulverization part, and furthermore, they are subject to a rapid corrosion of the orifices through which the sludge flows.

The present invention eliminates the drawbacks of the prior devices mentioned herein-above, and renders possible production of finely distributed dispersion, or pulverization, of the sludge in a delimited space (combustion space) the mean temperature of which is maintained within the limits compatible with a satisfactory combustion of the combustible portion of the particles of the sludge to be treated.

The method according to the present invention for incinerating sludges comprises the steps of:

delivering a very homogeneous mixture of at least one combustible gas with a large amount of excess air at a plurality of locations in the lower part of an incineration zone, initiating the combustion of said mixture, finely pulverizing the sludge in the combustion zone, evacuating the incineration products from the incineration zone by carrying them along with the gaseous combustion products, and controling precisely the temperature of the combustion products while they are evacuated from the incineration zone.

In this method, the step of finely pulverizing the sludge in the incineration zone comprises the steps of:

imparting to said sludge a rotational motion about an axis within a confined space by injecting the sludge in a substantially tangential direction into said space and in a direction substantially perpendicular to said axis, evacuating said sludge from said space in the form of a sludge outlet jet having a flow velocity substantially equal to the inlet velocity, and directing onto said sludge outlet jet a plurality of air jets in a direction substantially tangential with respect to said sludge outlet jet, said air jet being substantially perpendicular to the axis about which said sludge rotates.

In various embodiments of the invention, and especially when the sludges to be incinerated have a comparatively high hydrocarbon content, the minimum outlet temperature and the maximum outlet temperature of the combustion products are equal to about 750° C. and 950° C., respectively.

Generally the air used for forming the mixture delivered at a plurality of locations distributed over the lower part of the incineration zone is pre-heated by heat-exchange with the combustion products.

A device for carrying out the method according to the invention comprises an incineration chamber delimited by a continuous wall made of fire-proof or refractory material, said chamber extending between a sole made of refractory material, located in the lower part of the chamber, and an aperture opening into an outlet conduit for evacuating the incineration products, which aperture is located in the upper part of said chamber, said device further comprising:

a plurality of sole burners distributed over said refractory sole, each sole burner being provided with means for delivering a very homogeneous mixture of combustion gas and a large amount of excess air, means for pulverizing the sludge in the incineration chamber, said sludge pulverizing means being connected by two separate conduits to sludge feeding means and pressurized air feeding means, said pulverizing and feeding means being provided with cooling means, and the entire assembly being surrounded by a jacket made of heat-insulating material, and means for controlling precisely the temperature of the combustion products issuing from the incineration chamber.

In one embodiment of the device according to the invention, the means associated to the burners and adapted to deliver a very homogeneous mixture of combustible gas with a large amount of excess air are constituted by a homogenizing chamber communicating through large openings with a ventilating box provided beneath the sole and connected to air inlet means, each of said large openings having in its median portion an injecting nozzle connected to combustible gas inlet means, said homogenizing chamber being connected to the incineration chamber by a conduit having a cross-section smaller than that of said homogenizing chamber.

In a preferred embodiment of the device according to the invention each homogenizing chamber is connected to the incineration chamber by a conduit opening into the same through a divergent frusto-conical element.

In such a device the sludge spraying or pulverizing means are constituted by a pulverizing head comprising a sludge chamber delimited by a wall in the form of a surface of revolution about an axis defined within said sludge chamber, a sludge inlet conduit opening into the wall of said sludge chamber, and a plurality of air injectionconduits opening in substantially tangential directions into said coaxial cylindrical section.

In a preferred embodiment of the device according to the invention the end portion of each air injection conduit has its axis arranged in an orthogonal position with respect to the axis of the coaxial cylindrical section constituting the extension of the sludge chamber.

In another preferred embodiment of the device according to the invention the coaxial cylindrical section constituting the extension of the sludge chamber opens into the incineration chamber through a divergent frusto-conical coaxial section.

Optimum pulverization conditions are achieved when the air injection conduits open in substantially tangential directions into the periphery of the coaxial cylindrical section constituting the extension of the sludge chamber.

The invention will be described herein-below in a more detailed manner, especially with reference to the appended figures which show, by way of illustration, but without limitation, various embodiments of the device for carrying out the method according to the present invention.

FIG. 1 schematically shows an incineration chamber.

Figure 4:
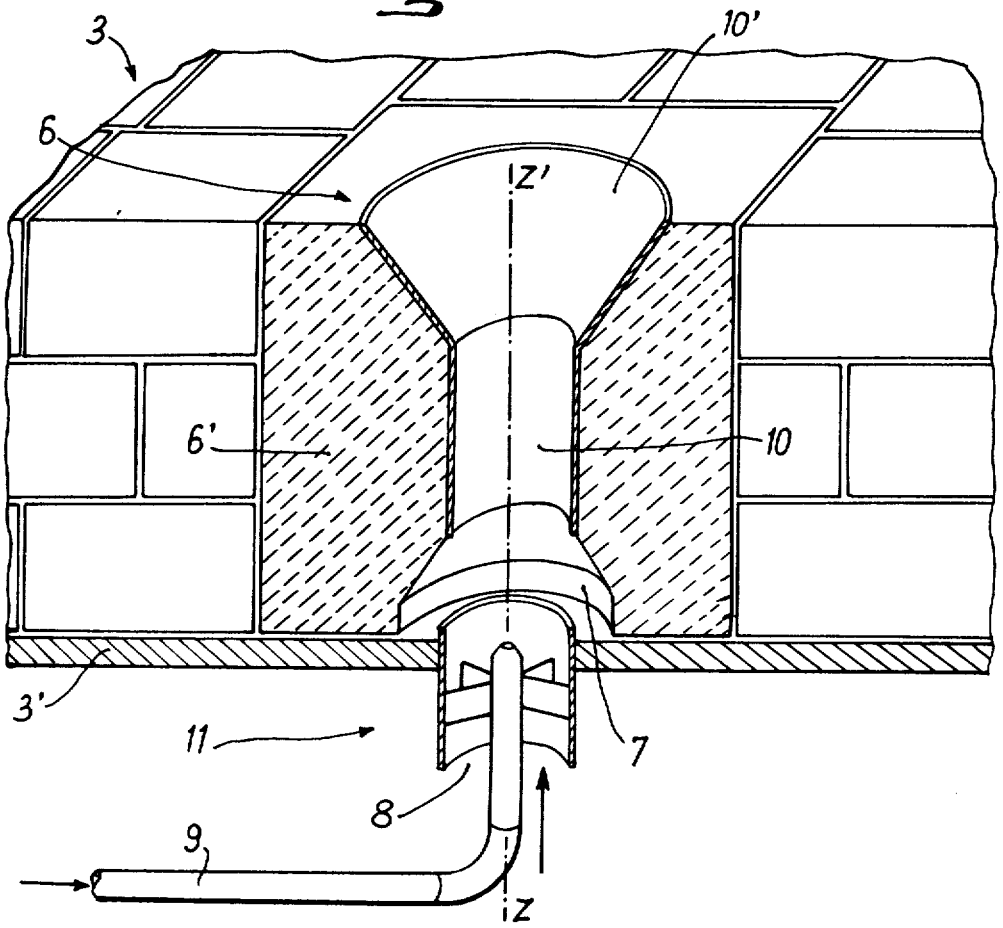

FIG. 4 schematically shows a sole burner.

Figure 5:
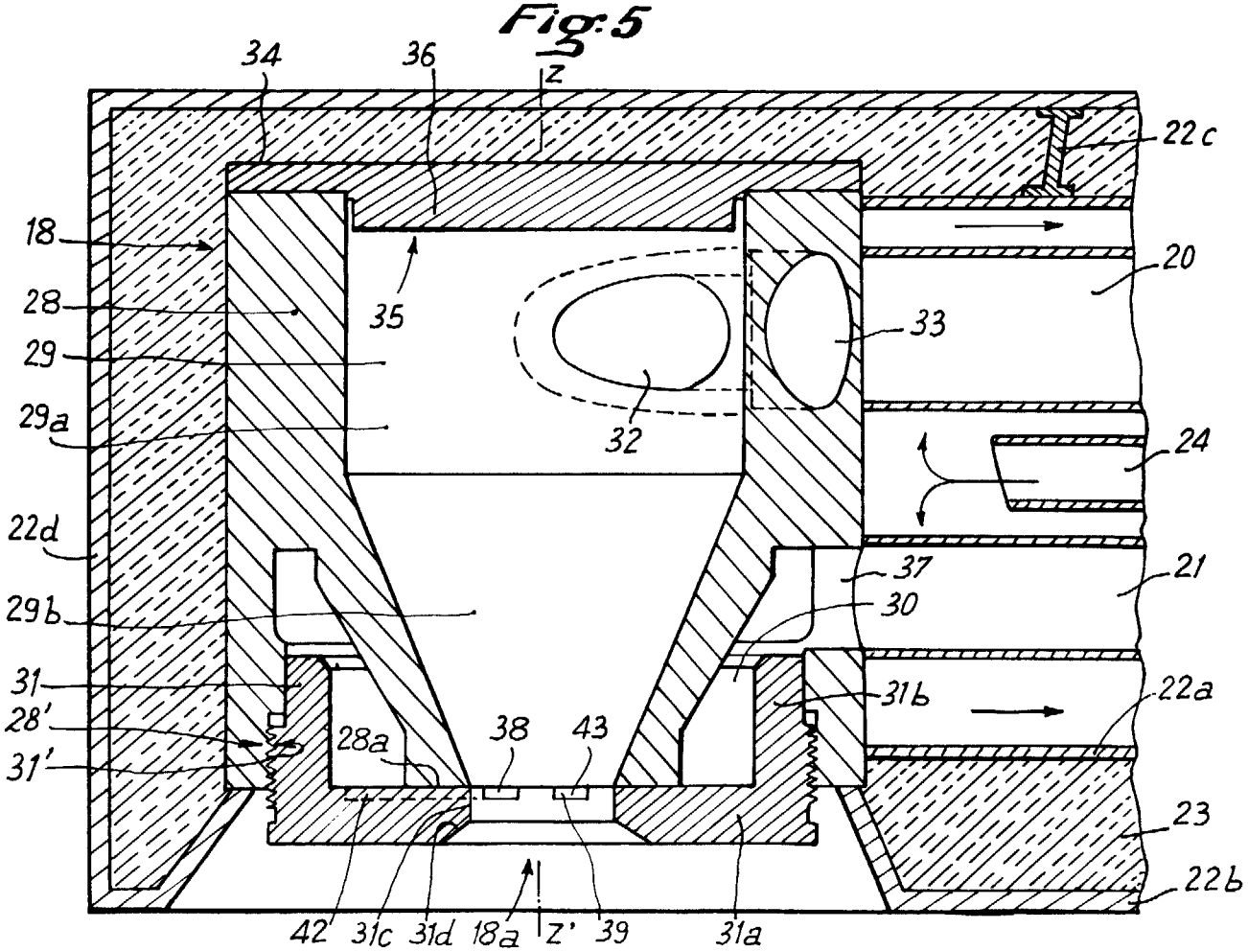

FIG. 5 is a sectional view of a pulverizing head.

Figure 6:
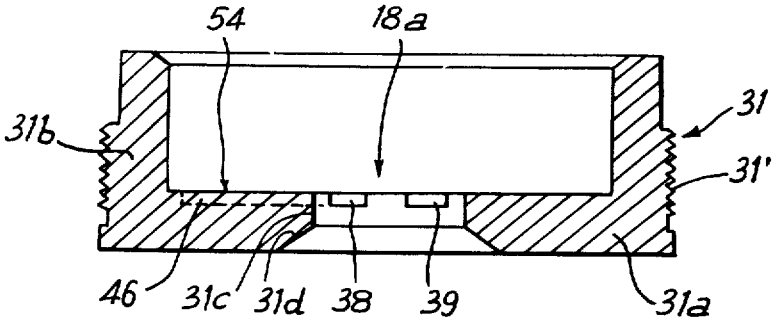

FIG. 6 is a sectional view of the ring member delimiting the air injection conduits.

Figure 7:
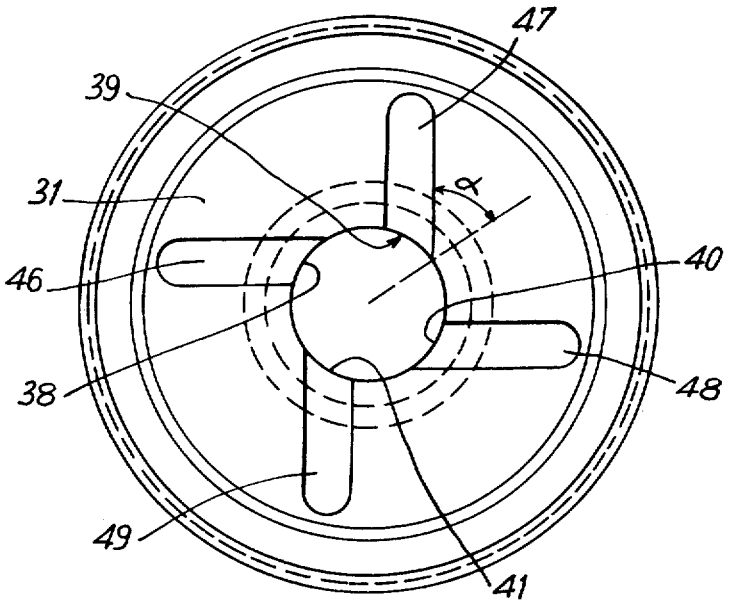

FIG. 7 is a plan view of the ring member shown in FIG. 6.

Figure 8:
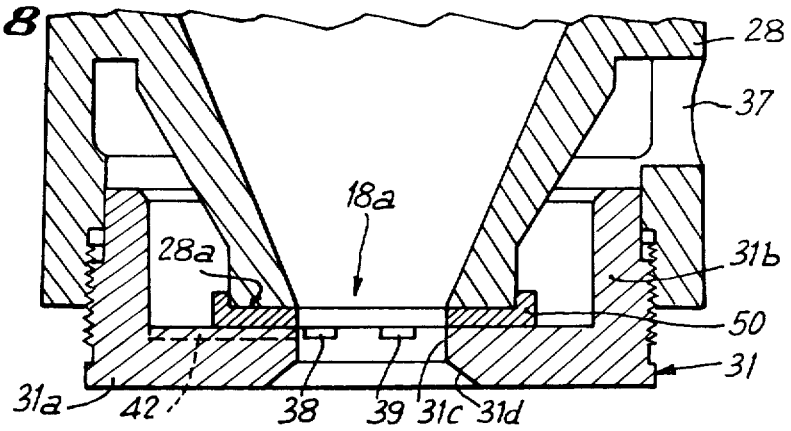

FIG. 8 shows a ring member with a wear-piece.

Figure 9:
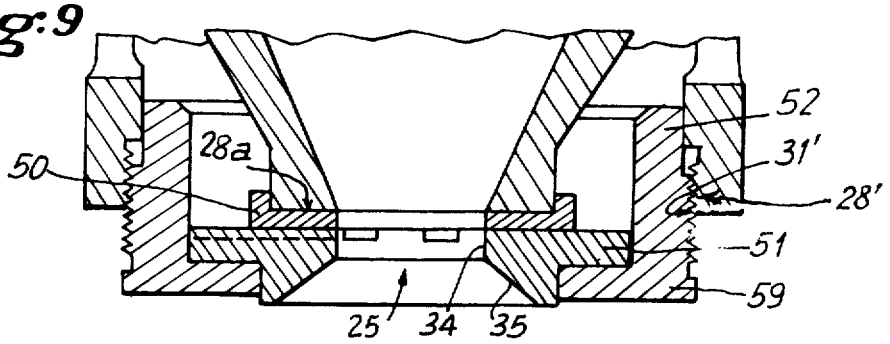

FIG. 9 shows a ring member with two wear-pieces.

Figure 10:
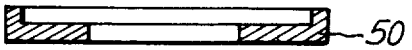

FIG. 10 is a sectional view of one of the wear-pieces according to FIG. 6.

Figure 11:
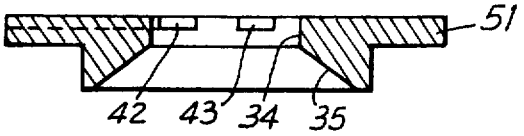

FIG. 11 is a sectional view of the other wear piece according to FIG. 8.

Figure 12:
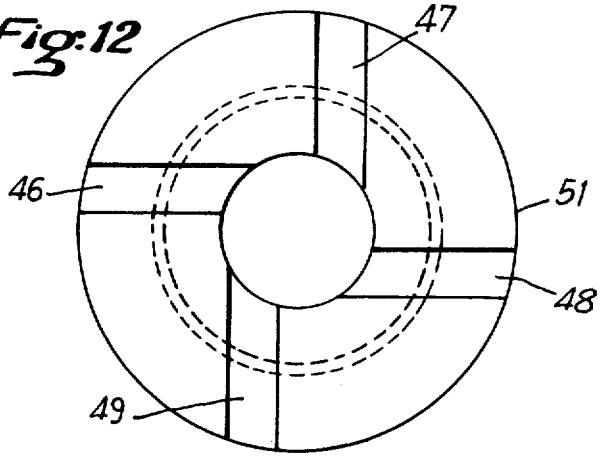

FIG. 12 is a plan view of the wear-piece according to FIG. 8.

Figure 1:
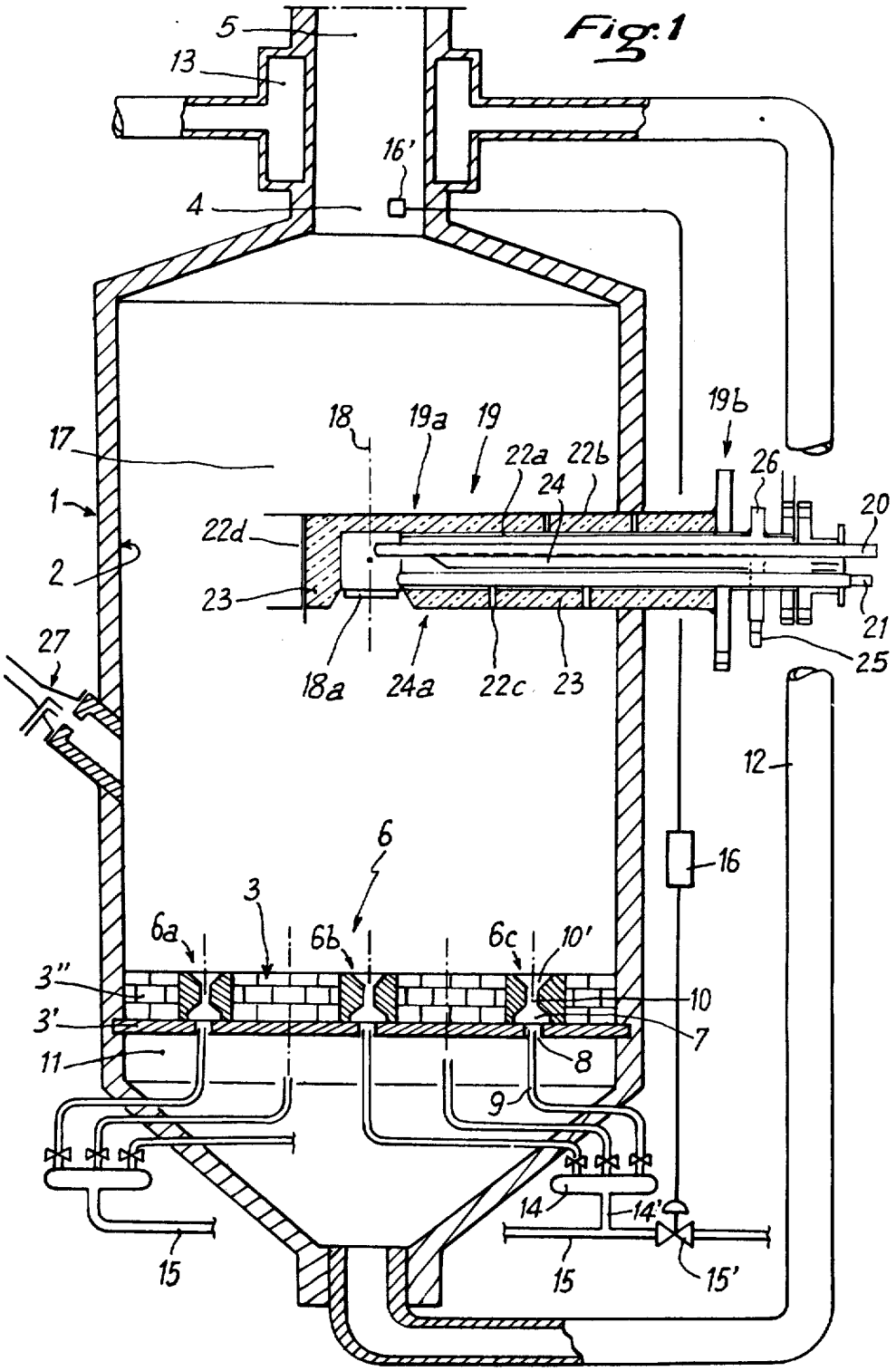

FIG. 1 schematically shows an incineration chamber 1 delimited by a wall 2 which extends between a sole 3 made of refractory material and an aperture 4 opening into a conduit 5 adapted to evacuate the incineration products.

Refractory sole 3 rests on a support 3', in general consisting of metal, and is constituted by a layer of refractory metal, such as bricks 3'', uniformly disposed; burners 6, such as shown at 6a, 6b, 6c are preferably distributed also as uniformly as possible on the sole.

Each burner comprises a homogeneous chamber into which opens an air inlet opening 8, an injection nozzle 9 for injecting pressurized combustible gas, and a conduit 10 having a small cross-section as compared to that of the homogenizing chamber 7, said conduit connecting chamber 7 to the incineration chamber 1 into which it opens through an opening which is generally tapered so as to define a frusto-conical shape.

Figure 2:
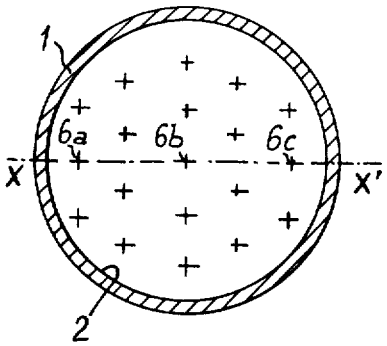
FIG. 2 shows the distribution of the burners on the sole.

FIG. 2 shows, by way of example, the arrangement of the axes of the uniformly distributed burners 6 provided on sole 3. This figure shows burners 6a, 6b, 6c, the axes of which are located in a plane XX'.

In FIG. 1 the pressurized combustion gas injection nozzle 9 is oriented along the axis of the air inlet opening 8 which is provided in support 3', the latter being constituted, in the embodiment shown, by a plate.

The air inlet openings 8 connect the homogenizing chamber to a ventilating box 11 provided beneath sole 3 and connected to air feeding means (not shown) by a heat-insulated conduit 12 and a heat exchanger 13 mounted on outlet conduit 5 which is adapted to evacuate the incineration products.

The various pressurized combusible gas injection nozzles 9 are connected, by groups of 3 nozzles each, to distributing chambers such as 14, each of which is connected by a conduit 14' to a feed pipe or line 15 provided with an automatic valve 15'. The latter is connected through servo-control means 16 to measuring means 16' adapted to measure the temperature of the incineration products flowing through outlet conduit 5, at a location adjacent to opening 4.

Chamber 14 is connected by nozzles 9 to burners 6b, 6c shown in FIG. 1 into a third burner (not shown in the figures). Another chamber 14a is connected to burner 6a shown in FIG. 1 and to two other burners (not shown).

Pulverizing means 17 for pulverizing the sludge comprise a pulverizing head 18 opening into the incineration chamber through pulverizing opening 18a. The pulverizing head is mounted onto the end 19a of a pulverizing rod 19 the other end of which, shown at 19b, is located outside the incineration chamber. Rod 19 extends through wall 2 where it is fixed in such a manner that pulverizing head 18 is maintained in the zone of the geometrical axis of the chamber.

Pulverizing head 18 is connected by a conduit 20 to sludge feeding means, and by a conduit 21 to pressurized air feeding means, these two feeding means are located outside the incineration chamber and are not shown in the drawings.

Conduits 20 and 21 are located within a tube 22a, or inner envelope, having a comparatively large diameter, the end of said tube or envelope which is located inside the combustion chamber being tightly fixed, e.g. by welding, onto the outer periphery of pulverizing head 18.

Inner envelope 22a is surrounded by a coaxial tube 22b, or outer envelope, having a comparatively large diameter, the inner envelope being fixed to the outer envelope by means of centering pieces such as 22b. Envelopes 22a and 22b are separated by an annular space filled with a heat-insulating material 23.

Outer envelope 22b is extended by an envelope 22d surroundingthe major part of pulverizing head 18, except the face thereof which is provided with the injection orifice 18a.

The filling material 23 extends into the entire space separating the outer periphery of pulverizing head 18 from envelope 22d.

A conduit 24 mounted coaxially with respect to inner envelope 22 opens into the latter in the vicinity of end 19a of rod 19 through an opening 24a.

Conduit 24 extends beyond the end 19b of rod 19 by a conduit 25 connected to cooling water feeding means (not shown in the drawing).

The annular space defined between conduit 24 and inner envelope 22a is connected to evacuating means by a conduit 26.

In the zone comprised between pulverizing rod 19 and sole 3, the wall 2 of the combustion chamber is provided with at least one ignition means for initiating the combustion, said ignition means being shown in the present example in the form of a burner 27 of a type known per se which is directed towards sole 3 of the combustion chamber. Burner 27 is associated to the conventional equipments comprising a flame detector, an ignition device and an optical surveying instrument (not shown).

Figure 3:
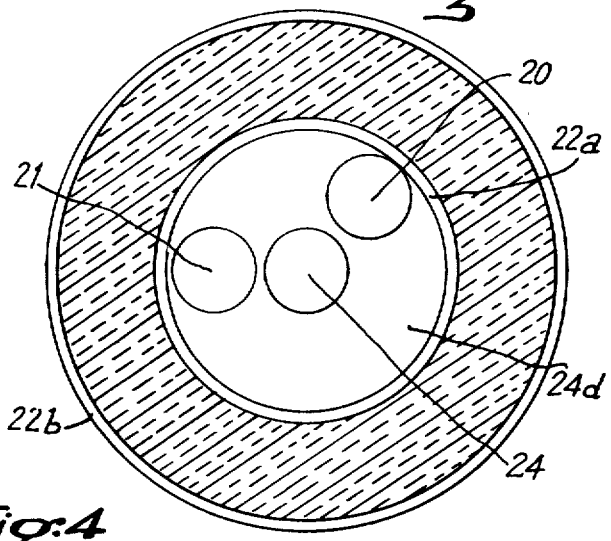
FIG. 3 is a sectional view of a pulverizing rod.

FIG. 3 shows in section a pulverizing rod 19, as well as the cross-sections of conduits 20, 21, 24 mounted within a cylindrical envelope the internal cross-section of which is indicated by reference numeral 22a. Conduit 24 and inner envelope 22a are separated by an annular space 24d.

Inner envelope 22a is surrounded by an outer coaxial envelope 22b and separated therefrom by an annular space containing a heat-insulating material 23.

FIG. 4 is a perspective view of a sole burner 6 comprising a block 6' made of refractory material the outer periphery of which has a parallelepipedic shape. As shown, block 6' is sectioned along a symmetry plane of the parallelepiped, which plane is parallel to one of the surfaces of the parallelepiped. The support 3' of sole 3 is also shown in section, taken in the same symmetry plane of block 6'.

FIG. 4 permits the location, with respect to a single symmetry axis ZZ', of the aperture 8 provided in support 3' for the admission of air into homogenizing chamber 7, which is shown in the present embodiment as having a cylindrical shape, and into conduit 10 which connects homogenizing chamber 7 to incineration chamber 1 wherein said conduit opens into tapered frusto-conical opening 10'.

FIG. 5 is a sectional view of a sludge pulverizing head 18 mounted to the end 19a of sludge pulverizing rod 19, as shown in FIG. 1.

Pulverizing head 18 is tightly mounted onto the end of tube, or inner envelope, 22a, preferably by a continuous weld seam.

As already explained herein-above with reference to FIG. 1, tube, or outer envelope 22b, which is coaxial to tube 22a and fixed thereto by means of centering pieces such as 22c is extended by an envelope 22d, surrounding pulverizing head 18 which it contacts on the periphery of the surface provided with pulverizing orifice 18a.

A heat-insulating material 23 is placed in the space separating, on the one hand, the inner envelope 22a from the outer periphery of the pulverizing head 18, with the exception of the face provided with pulverizing orifice 18a, and, on the other hand, the outer envelope 22b.

Pulverizing head 18 essentially comprises a piece 28 having an outer periphery of a cylindrical shape and a circular cross-section and being provided with an axial bore or sludge chamber 29, as well as with an annular recess or air recess 30 isolated from the sludge chamber 29 and opening through an annular aperture into an end face 28a of piece 28; said pulverizing head further comprises a ring member 31 removably mounted onto end face 28a of piece 28, preferably by means of a screw thread as shown at 32, said ring member delimiting together with end face 28a of piece 28 air outlet conduits for evacuating air from air recess 30.

Axial bore or sludge chamber 29 mainly comprises a cylindrical portion 29a into the periphery of which opens in a substantially tangential direction, nd perpendicularly to the axis of said sludge chamber, an orifice 32 of a bore 33 provided in the wall of the sludge chamber, said hole being extended in a tight manner by a conduit 20' connected to a sludge feeding source.

The cylindrical portion 29a is followed by a convergent frusto-conical portion 29b coaxial to cylindrical portion 20a and opening into end face 28a, the section of said opening being substantially equal to that of orifice 32.

At its end opposite to face 28a provided with injection orifice 18a piece 28 comprises a circular planar surface 34 provided with a circular opening 35 corresponding to the cross-section of the cylindrical portion of sludge chamber 29. Opening 35 is sealed by a metallic plug 36 which is tightly fixed and in such a manner that it resists the pressure of the sludge.

Annular recess, or air recess 30, communicates through an orifice 37 provided in piece 28 with conduit 21 which is connected to a pressurized air source.

In the embodiment shown in FIGS. 5, 6 and 7, ring member 31 is constituted by a single piece represented in FIG. 6 in cross-sectional and elevational view, whereas FIG. 7 shows the same piece in plan view.

Ring member 31 comprises two portions, respectively an annular portion delimited by two parallel planar surfaces 31a, and an annular skirt 31a delimited at its outside by a cylindrical surface having the maximum overall diameter of annular portion 31a, said skirt being provided with an outer screw thread 31' corresponding to an inner screw thread 28' provided on piece 28.

Annular portion 31 delimits the end portion of injection orifice 18b by a cylindrical passage 31c which is an extension of the end opening of the frusto-conical convergent portion 29a of sludge chamber 29, and by a divergent frusto-conical passage 31d.

A plurality of orifices 38, 39, 40 and 41 open into the periphery of cylindrical passage 31c, said orifices corresponding to an equal number of conduits 42, 43, 44 and 45 opening into air cavity 30 and delimited, on the one hand, by grooves 46, 47, 48 and 49 provided on ring member 31, and, on the other hand, by the end face 28a of piece 28.

Only orifices 38 and 39 and conduits 42 and 43 are visible on FIG. 5.

Conduits 42, 43, 44 and 45 as shown in FIGS. 5, 6, and 7 have the shape of cylinders with rectilinear generatrices.

In the various embodiments the conduits 42, 43, 44 and 45 open into the cylindrical section in a substantially tangential direction.

In the embodiment shown in FIG. 8 the conduits 42, 43, 44 and 45, only two of which (42 and 43) are visible, are delimited by a ring member 50 mounted on the annular surface 28a and by grooves 46, 47, 48 and 49 formed in a ring member 31 which has the same shape and dimensions as those of ring member 31 described with reference to FIGS. 5, 6 and 7.

In another embodiment, shown in FIGS. 9, 10, 11, and 12, the device comprises a ring member 50 similar to the one shown in FIG. 8. The ring member 31 according to FIG. 8 is replaced in thepresent embodiment by two annular elements 51 and 52 separated from each other by a coaxial annular surface. This annular separating surface is provided with a shoulder which is shaped in such a manner that element 51 delimiting sections 31c and 31d of the pulverizing orifice 18a and the periphery of grooves 46, 47, 48 and 49 is supported by element 52 provided with annular skirt 31b and screw thread 32.

FIG. 10 is a sectional view of element 50.

FIG. 11 shows element 51, and FIG. 12 is a plan view thereof.

Ring members 50 and 31 according to FIG. 8 and ring members 50 and 51 according to FIG. 9 constitute wear pieces, the replacement of which allows rapid repair of the pulverizing head.

The operation of the sludge incineration described hereinabove with reference to FIGS. 1 to 12 may be explained as follows:

In a preliminary phase, igniting the auxiliary burner enables the temperature of the sole to be raised to a value high enough to initiate the operation of the sole burners when the latter are fed.

When the mean temperature in the combustion chamber is stabilized at a value of about 850° C., the useful operating phase is started by injecting sludge by means of the pulverizing head. The incineration products are evacuated together with the combustion products resulting from the burning of the gas fed to the burners; various means known per se are then used for precipitating and evacuating the dust particles.

Pulverizing the sludge requires variable amounts of heat, depending on the volume of the water to be vaporized; during the pulverizing process a certain amount of heat is produced, depending on the amount of combustible matter, e.g. liquid or solid hydrocarbons, present in the sludge.

A control mechanism known per se maintains the temperature at aperture 4, through which the incineration chamber opens into the outlet conduit 5, at a value comprised between convenient limits, particularly between 750° C. and 950° C., by acting on a motor-driven valve 15' provided on inlet conduit 15 that feeds the combustible gas to the sole burners.

The heat balance of the installation is improved by pre-heating the air in a heat exchanger provided on the fume outlet duct or conduit.

In practice, it has been observed that such an incineration device consumes 600 to 700 $m^3$ of gas containing 95% methane for treating 4 tons of sludge per hour.

Since the calorific power of 600 to 700 $m^3$ of such a gasis equivalent to that of 0.6 ton of liquid hydrocarbons formed fuel, the consumption of such device is equal to about 0.15 ton of hydrocarbon fuel equivalent per ton of sludge.

When the sludge contains combustible substances, especially hydrocarbons, the latter contribute to the combustion, whereby the gas consumption of the device is reduced. It has been confirmed in practice that the gas consumption per ton of incinerated sludge decreases as the hydrocarbon content of the sludge increases.

Various particular features of the sludge incinerating device result in a very long service-life of the different constituents: the lay out of the sole burners is such that the latter are able to operate during long periods of time without undergoing abrasion and without getting clogged. The structure of the pulverizing rod provided with means for water cooling is such that said rod is rigid enough to maintain the injection head in its required position, i.e. with its pulverizing orifice axis extending vertically. The only interruptions of the operation of the device are those which are rendered necessary by the replacement of the wear pieces of the injection head; by conveniently selecting the alloys for manufacturing these pieces it is possible to operate the device during long intervals of time between two successive interruptions.

An incineration device according to the invention is able to operate in a most satisfactory, continuous manner with a perfectly favourable energetic balance, producing excellent economic results.

It is thus possible to incinerate sludge under acceptable conditions, as regards the polluting effluents produced by many industrial installations.

The invention is not limited to the embodiments shown and described herein. Those skilled in the art may envisage numerous variants and modifications without departing from the spirit and scope of the invention as defined in the appended claims.

What is claimed is:

1. A method for incinerating sludge, comprising the steps of:

delivering a mixture of combustible gas with a large amount of excess air to a plurality of locations distributed over the lower part of an incineration zone;

initiating the combustion of said mixture;

injecting sludge into a limited space while imparting to said sludge a rotational motion about an axis, and causing said sludge to leave said space in the form of a sludge outlet jet, and finely pulverizing the sludge in the incineration zone;

evacuating the incineration products from the incineration zone by carrying them along with the gaseous combustion products;

said method being characterized by the further steps of:

rendering said mixture of combustible gas with excess air extremely homogeneous, prior to said step of delivering it to said locations in said incineration zone, and directing plurality of air jets onto said sludge outlet jet in a substantially tangential direction with respect to the latter, for carrying out said step of finely pulverizing the sludge outlet jet.

2. The method of claim 1, characterized in that it further comprises the steps of:

injecting said combustible gas under pressure into a homogenizing space into which a large amount of excess air is also admitted, and delivering the resulting homogeneous mixture into a combustion space wherein said mixture is burnt at said locations within the lower part of said incinerating zone.

3. The method of any of claims 1 or 2, wherein the minimum and the maximum values of the evacuation temperature of the combustion products are so selected that they are comprised between 750° C. and 950° C.

4. A device wherein an incineration chamber delimited by a continuous wall made of a refractory material extends between a sole of refractory material located at the lower part of said chamber and an aperture opening into an outlet conduit adapted to evacuate the products of incineration, said aperture being located at the upper part of said chamber, said device further comprising:

a plurality of sole burners distributed over said sole, each burner being provided with means for delivering a very homogeneous mixture of a combustible gas with a large amount of excess air, and means for finely pulverizing the sludge in said incineration chamber, said pulverizing means being connected by two separate conduits to sludge feeding means and pressurized air feeding means, respectively, said pulverizing means and feeding means being provided with cooling means, and the entire assembly being surrounded by a sleeve made of heat-insulating material.

5. The device of claim 4, wherein said means for delivering to each burner a very homogeneous mixture of combustible gas with a large amount of excess air are constituted each by a homogenizing chamber communicating through a large opening with a ventilating box located beneath said sole and connected to air feeding means, each one of the large openings being provided in its median portion with an injecting nozzle connected to combustible gas feeding means, and each homogenizing chamber being connected to said incineration chamber by a conduit having a cross-section smaller that that of said homogenizing chamber.

6. The device of claim 5, wherein each homogenizing chamber is connected to the incineration chamber by a conduit comprising a divergent frusto-conical end portion.

7. The device of claim 5, wherein said sludge pulverizing means are constituted by a pulverizing head comprising a sludge chamber delimited by a wall in the form of a surface of revolution about an axis which forms the sludge chamber axis, said sludge chamber being extended by a divergent conduit coaxial to said sludge chamber and coaxial cylindrical section opening into said incineration chamber, a sludge inlet conduit opening into the wall of said sludge chamber, and a plurality of air injection conduits opening into said coaxial cylindrical section in substantially tangential directions.

8. The device of claim 7, wherein the end portion of said air injection conduit is arranged in such a manner that its axis is orthogonal with respect to the coaxial cylindrical section, in line with said sludge chamber.

9. The device of claim 7, wherein said coaxial cylindrical section in line with said sludge chamber opens into said incineration chamber through a coaxial divergent frusto-conical section.

10. The device of claim 7, wherein said air injection conduits open into the periphery of said coaxial cylindrical section in line with said sludge chamber in substantially tangential directions, oriented in the direction in which the sludge inlet conduit opens into said sludge chamber.

* * * * *